US011441359B2

(12) United States Patent
Du et al.

(10) Patent No.: US 11,441,359 B2
(45) Date of Patent: Sep. 13, 2022

(54) FORCED SEPARATION DEVICE FOR SUBMARINE DRILLING MACHINE AND DRILLING TOOL

(71) Applicant: Institute of Exploration Techniques, Chinese Academy of Geological Sciences, Tianjin (CN)

(72) Inventors: Yaosen Du, Tianjin (CN); Xiaolong Wu, Tianjin (CN); Pengju Gao, Tianjin (CN); Qingxiao Wang, Tianjin (CN); Xiangyu Dong, Tianjin (CN); Xiaoren Tang, Tianjin (CN); Yuan Zhao, Tianjin (CN); Xiaosai Wang, Tianjin (CN)

(73) Assignee: Institute of Exploration Techniques, Chinese Academy of Geological Sciences, Tianjin (CN)

( * ) Notice: Subject to any disclaimer, the term of this patent is extended or adjusted under 35 U.S.C. 154(b) by 0 days.

(21) Appl. No.: 17/246,686

(22) Filed: May 2, 2021

(65) Prior Publication Data

US 2022/0074268 A1 Mar. 10, 2022

(30) Foreign Application Priority Data

Sep. 4, 2020 (CN) ..... 202010918712.7

(51) Int. Cl.

| | |
|---|---|
| ***E21B 7/124*** | (2006.01) |
| ***F42B 3/02*** | (2006.01) |
| ***E21B 17/03*** | (2006.01) |

(52) U.S. Cl.

CPC ..... *E21B 7/124* (2013.01); *F42B 3/02* (2013.01); *E21B 17/03* (2013.01)

(58) Field of Classification Search

CPC ..... E21B 7/124; E21B 17/03; E21B 7/1245; F42B 3/02

See application file for complete search history.

(56) References Cited

U.S. PATENT DOCUMENTS 3,670,830 A * 6/1972 Van Der Wijden ... E21B 19/146 175/52

FOREIGN PATENT DOCUMENTS

GB 2497325 A * 6/2013 ..... E21B 41/08

* cited by examiner

*Primary Examiner* — James G Sayre

(74) *Attorney, Agent, or Firm* — Bochner IP, PLLC; Andrew D. Bochner

(57) ABSTRACT

A forced separation device includes a transmission shaft, a main shaft, an electromagnetic transmission mechanism, a blasting separation mechanism and a pressure-resistant cabin. A pressing cover is fastened to the upper portion of the pressure-resistant cabin. The electromagnetic transmission mechanism is provided with a driving chuck and a driven chuck. The driving chuck is connected with the transmission shaft, the driven chuck is connected with the main shaft, the pressing cover is welded with the transmission shaft, and the driven chuck is welded with the lower portion of the pressure-resistant cabin. The blasting separation mechanism is provided with explosive packages and detonators. A plurality of explosive packages are distributed between the pressing cover and the top surface of the pressure-resistant cabin, and each explosive package is connected with the corresponding detonator respectively. The pressure-resistant cabin is further internally provided with a storage battery.

9 Claims, 3 Drawing Sheets

FORCED SEPARATION DEVICE FOR SUBMARINE DRILLING MACHINE AND DRILLING TOOL

CROSS REFERENCE TO RELATED APPLICATION

This patent application claims the benefit and priority of Chinese Patent Application No. 202010918712.7, filed on Sep. 4, 2020, the disclosure of which is incorporated by reference herein in its entirety as part of the present application.

TECHNICAL FIELD

The present disclosure relates to a submarine drilling rig, in particular to a forced separation device for a submarine drilling machine and a drilling tool.

BACKGROUND ART

Submarine drilling machine is drilling equipment that works on a seabed alone. According to different drilling requirements, the working seawater depths of the submarine drilling machines are greatly different from hundreds of meters to thousands of meters or even tens of thousands of meters. Usually, the submarine drilling machine is carried on a mother ship, such as a scientific research ship, and when the mother ship arrives at a designated position, the drilling machine is lowered to the seabed through an extension and retraction system, including components such as a winch and an A-shaped frame, on a deck of the mother ship. A control room of the submarine drilling machine is mounted on the deck of the mother ship, a channel connecting the control room and the submarine drilling machine is an umbilical cable, and the umbilical cable is used for lowering and recycling the drilling machine and also used for transmitting power, control signals and related data. Professional cameras are mounted at key parts of the submarine drilling machine, video data can be directly transmitted to a display screen of the control room, and an operator can remotely control the drilling machine to work in the control room on the deck of the mother ship. When the submarine drilling machine drills, various emergencies such as hydraulic system failure, in-hole collapse and drill burying occur sometimes, the emergencies cause that the drilling tool cannot be disassembled and the drilling machine can only be recycled through the umbilical cable, but the drilling machine must be disengaged from the drilling tool when the drilling tool is recycled, and the drilling tool cannot be recycled but discarded once the drilling tool cannot be disengaged from the drilling machine.

SUMMARY

The present disclosure aims to provide a forced separation device for a submarine drilling machine and a drilling tool. The forced separation device can be used for quickly disengaging the drilling machine from the drilling tool in submarine drilling emergency situations, so that the drilling machine is smoothly recycled.

The problem of the present disclosure is solved by the following technical scheme:

The forced separation device for a submarine drilling machine and a drilling tool comprises a transmission shaft, a main shaft, an electromagnetic transmission mechanism, a blasting separation mechanism and a pressure-resistant cabin, a pressing cover is fastened to the upper portion of the pressure-resistant cabin, the electromagnetic transmission mechanism is provided with a driving chuck and a driven chuck which are attracted with each other, the driving chuck is connected with the transmission shaft, the driven chuck is connected with the main shaft, the pressing cover is welded with the transmission shaft, and the driven chuck is welded with the lower portion of the pressure-resistant cabin; the blasting separation mechanism is provided with a plurality of explosive packages and detonators, the explosive packages are distributed between the pressing cover and the top surface of the pressure-resistant cabin, and each explosive package is connected with the corresponding detonator respectively; and the pressure-resistant cabin is further internally provided with a storage battery for supplying power to the electromagnetic transmission mechanism and the blasting separation mechanism.

According to the forced separation device for a submarine drilling machine and a drilling tool, the pressing cover and the pressure-resistant cabin are connected through a plurality of screws, each explosive package corresponds to the corresponding screw respectively, and the explosive packages are glued with the pressing cover through super glue.

According to the forced separation device for a submarine drilling machine and a drilling tool, a clamping groove is formed in the main shaft, a snap ring is mounted in the clamping groove, a snap ring mounting groove is formed in the driven chuck, and the snap ring is located in the snap ring mounting groove.

According to the forced separation device for a submarine drilling machine and a drilling tool, a detonation switch and a separation switch are arranged on the side wall of the pressure-resistant cabin, the detonation switch is connected with the detonators and the storage battery through circuits respectively, and the separation switch is connected with the electromagnetic coils and the storage battery through circuits respectively.

According to the forced separation device for a submarine drilling machine and a drilling tool, the pressure-resistant cabin is externally provided with a pressure compensator connected with the pressure-resistant cabin.

According to the forced separation device for a submarine drilling machine and a drilling tool, the driving chuck is formed by folding chuck upper bodies and chuck lower bodies, and electromagnetic coils are located between the chuck upper bodies and the chuck lower bodies.

According to the forced separation device for a submarine drilling machine and a drilling tool, the driving chuck is connected with the transmission shaft through a flat key.

According to the forced separation device for a submarine drilling machine and a drilling tool, the driven chuck is in threaded connection with the main shaft.

According to the forced separation device for a submarine drilling machine and a drilling tool, a sealing gasket is arranged between the pressing cover and the pressure-resistant cabin.

The device is designed for solving the problem that the drilling machine is recycled when marine drilling encounters emergencies, when the submarine drilling machine works normally, the transmission shaft is connected with the main shaft through the electromagnetic transmission mechanism, torque output by a power head is transmitted to the main shaft, and the lower end of the main shaft is connected with the drilling tool to drive drilling; when the submarine drilling machine needs to be disengaged from the drilling tool in emergency, a remote operated vehicle sequentially triggers the separation switch and the detonation switch, in this way, the electromagnetic transmission mechanism is cut off firstly, then the detonation separation mechanism detonates, the transmission shaft and the main shaft are forcibly disconnected, the drilling machine and the drilling tool are rapidly separated, and the submarine drilling machine can be recycled by starting a winch on a drilling ship. The device solves the recycling problem of drilling machines for submarine drilling.

BRIEF DESCRIPTION OF THE DRAWINGS

The present disclosure is further described below in combination with the attached figures.

Reference signs: 1, transmission shaft; 2, pressing cover; 3, explosive package; 4, sealing gasket; 5, pressure-resistant cabin; 6, pressure compensator; 7, chuck upper body; 8, electromagnetic coil; 9, chuck lower body; 10, snap ring; 11, driven chuck; 12, main shaft; 13, storage battery; 14, separation switch; 15, detonation switch; 16, flat key; 17, wire; 18, screw; and 19, detonator.

DETAILED DESCRIPTION OF THE EMBODIMENTS

Figure 1:
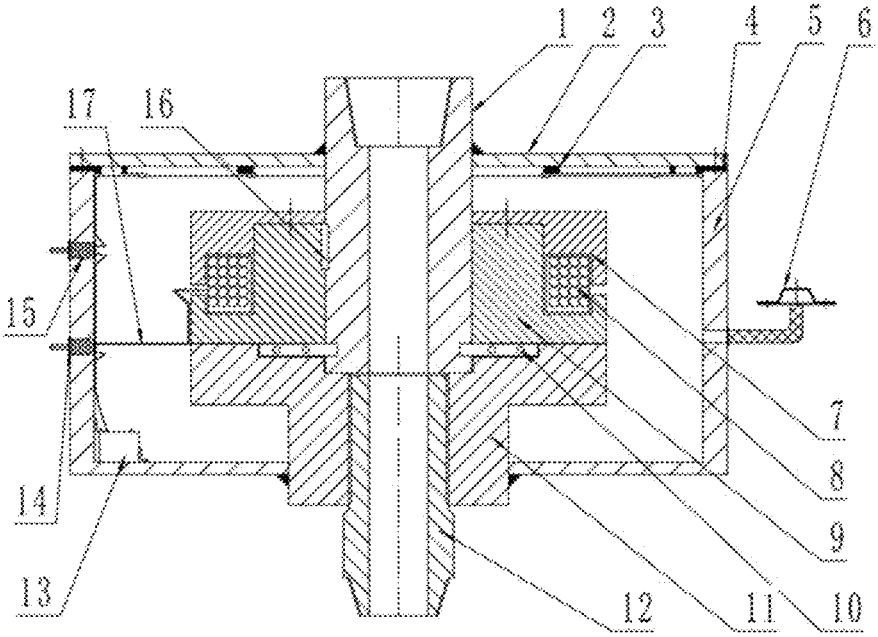
FIG. 1 is a structural diagram of the present disclosure.
Figure 2:
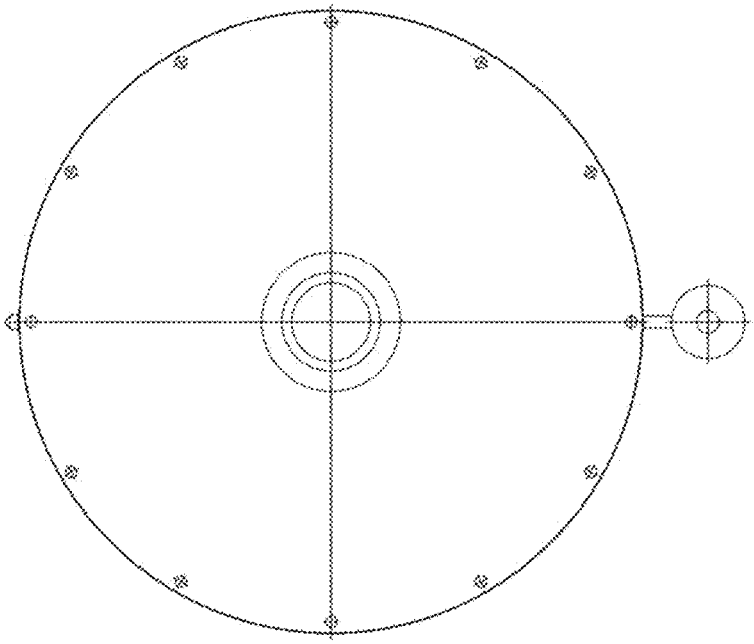
FIG. 2 is a top view of FIG. 1.
Figure 3:
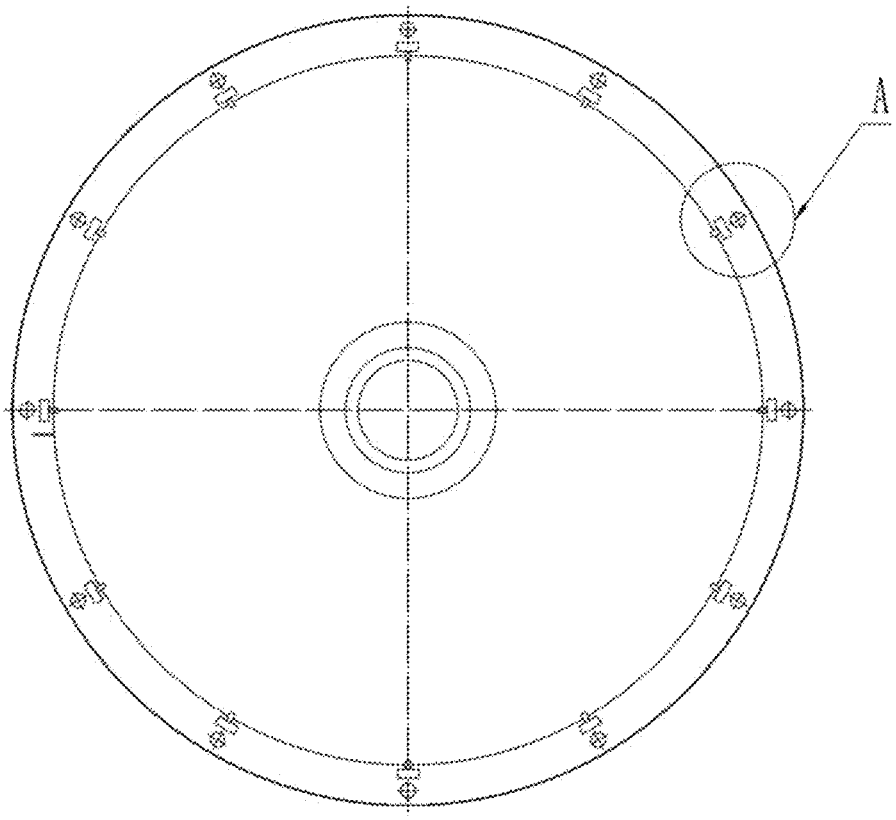
FIG. 3 is a schematic diagram for distribution of explosive packages.
Figure 4:
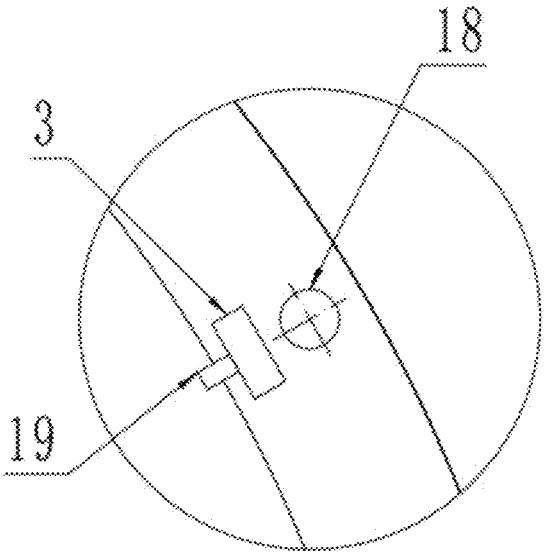
FIG. 4 is a partial enlarged diagram of an A part in FIG. 3.
Figure 5:
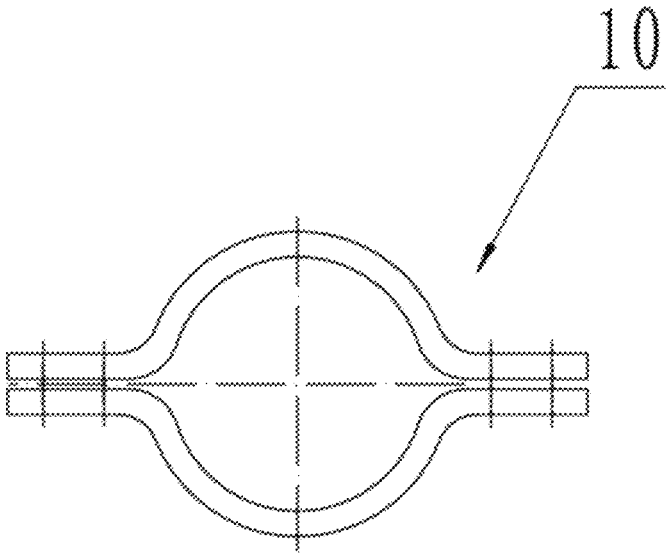
FIG. 5 is a structural schematic diagram of a snap ring.

Referring to FIG. 1 and FIG. 5, a forced separation device for a submarine drilling machine and a drilling tool comprises a transmission shaft 1, a main shaft 12, an electromagnetic transmission mechanism, a blasting separation mechanism and a pressure-resistant cabin 5, a pressing cover 2 is fastened to the top of the pressure-resistant cabin, a sealing gasket 4 is arranged between the pressing cover and the pressure-resistant cabin, and the pressing cover is fastened with the pressure-resistant cabin through screws 18, so that a closed cavity is formed in the pressure-resistant cabin. The upper end of the transmission shaft is in threaded connection with the output shaft of a power head to transmit power of the output shaft of the power head. The main shaft is welded with the pressing cover. The electromagnetic transmission structure is provided with a driving chuck and a driven chuck 11 which are attracted with each other. The driving chuck is formed by folding chuck upper bodies 7 and chuck lower bodies 9, and electromagnetic coils are located between the chuck upper bodies and the chuck lower bodies. The driving chuck is connected with the transmission shaft through a flat key 16, and rotates along with the transmission shaft. The driven chuck is in threaded connection with the main shaft, the lower end of the main shaft is connected with the drilling tool, and the driven chuck is welded with the lower portion of the pressure-resistant cabin. A clamping groove is formed in the main shaft, a snap ring 10 is mounted in the clamping groove, a snap ring mounting groove is formed in the driven chuck, and the snap ring is located in the snap ring mounting groove. The snap ring plays a role in supporting the driving chuck and also has an axial positioning function. The pressure-resistant cabin is further internally provided with a storage battery 13 for supplying power to the electromagnetic transmission mechanism and the blasting separation mechanism. The pressure-resistant cabin is externally provided with a pressure compensator 6 connected with the pressure-resistant cabin. When the submarine drilling machine works normally and the electromagnetic transmission mechanism is in a power-on state, the driving chuck and the driven chuck are attracted to transmit torque and rotating speed of the power head to the main shaft, the lower end of the main shaft is connected with the drilling tool, and a drilling function is achieved.

Referring to FIG. 1 to FIG. 4, the blasting separation mechanism is used for forcing the submarine drilling machine to be disengaged from the drilling tool in submarine emergency situations. The blasting separation mechanism is provided with a plurality of explosive packages 3, the explosive packages are distributed between the pressing cover and the top surface of the pressure-resistant cabin, each explosive package corresponds to the corresponding screw respectively, the explosive packages are fixed with the pressing cover through super glue, and each explosive package is connected with the corresponding detonator 19 respectively. The detonators are electric delay fuses with a delay function, the delay time between different detonators is set according to the distance between different explosive packages and the electric signal transmission speed, the capacity required for destroying the force is calculated according to the pre-tightening force of bolts, and then explosives are configured and packaged, so that the purpose of blasting is achieved. A detonation switch 15 and a separation switch 14 are arranged on the side wall of the pressure-resistant cabin, the detonation switch is connected with the detonators and the storage battery through circuits respectively, and the separation switch is connected with the electromagnetic coils and the storage battery through circuits respectively. The detonation switch and the separation switch are toggle switches, so that the switches are prevented from being pressed and forced to start by seawater pressure.

When the drilling tool needs to be discarded and the submarine drilling machine needs to be recycled under the special conditions of collapse in a well or power failure of the drilling machine and the like, an ROV (remote operated vehicle, scientific investigation or geological survey ship standard equipment) is released underwater, and the ROV firstly shifts the separation switch, so that two chucks of the electromagnetic transmission mechanism are powered off and separated; and then the detonation switch is shifted, the detonators initiate the explosive packages to directionally explode to separate the pressing cover from the pressure-resistant cabin, so that the part above the electromagnetic driving chuck and the part below the electromagnetic driven chuck are forcibly separated, the submarine drilling machine can be lifted, and recycling of the submarine drilling machine is achieved.

What is claimed is:

1. A forced separation device for a submarine drilling machine and a drilling tool, comprising a transmission shaft, a main shaft, an electromagnetic transmission mechanism, a blasting separation mechanism and a pressure-resistant cabin, wherein a pressing cover is fastened to an upper portion of the pressure-resistant cabin, the electromagnetic transmission mechanism is provided with a driving chuck and a driven chuck which are attracted with each other, the driving chuck is connected with the transmission shaft, the driven chuck is connected with the main shaft, the pressing cover is welded with the transmission shaft, and the driven chuck is welded with a lower portion of the pressure-resistant cabin; the blasting separation mechanism is provided with a plurality of explosive packages and detonators, the explosive packages are distributed between the pressing cover and a top surface of the pressure-resistant cabin, and each explosive package is connected with a corresponding detonator respectively; and the pressure-resistant cabin is further internally provided with a storage battery for supplying power to the electromagnetic transmission mechanism and the blasting separation mechanism.

2. The forced separation device according to claim 1, wherein the pressing cover and the pressure-resistant cabin are connected through a plurality of screws, each explosive package corresponds to a corresponding screw respectively, and the explosive packages are glued with the pressing cover through super glue.

3. The forced separation device according to claim 2, wherein a clamping groove is formed in the main shaft, a snap ring is mounted in the clamping groove, a snap ring mounting groove is formed in the driven chuck, and the snap ring is located in the snap ring mounting groove.

4. The forced separation device according to claim 3, wherein a detonation switch and a separation switch are arranged on a side wall of the pressure-resistant cabin, the detonation switch is connected with the detonators and the storage battery through circuits respectively, and the separation switch is connected with the electromagnetic coils and the storage battery through circuits respectively.

5. The forced separation device according to claim 4, wherein the pressure-resistant cabin is externally provided with a pressure compensator connected with the pressure-resistant cabin.

6. The forced separation device according to claim 5, wherein the driving chuck is formed by folding chuck upper bodies and chuck lower bodies, and electromagnetic coils are located between the chuck upper bodies and the chuck lower bodies.

7. The forced separation device according to claim 6, wherein the driving chuck is connected with the transmission shaft through a flat key.

8. The forced separation device according to claim 7, wherein the driven chuck is in threaded connection with the main shaft.

9. The forced separation device according to claim 8, wherein a sealing gasket is arranged between the pressing cover and the pressure-resistant cabin.

* * * * *